United States Patent [19]

Howland

[11] Patent Number: 4,957,080

[45] Date of Patent: Sep. 18, 1990

[54] ENGINE PROTECTION SYSTEM

[76] Inventor: Mark W. Howland, 6198 Fireside La., Allenton, Wis. 53002

[21] Appl. No.: 238,178

[22] Filed: Aug. 30, 1988

[51] Int. Cl.[5] ..... F02M 39/00

[52] U.S. Cl. ..... 123/198 D; 123/372; 123/386

[58] Field of Search ..... 123/198 D, 198 DB, 386, 123/365, 359, 196 S, 373, 372; 73/119 A

[56] References Cited

U.S. PATENT DOCUMENTS

| | | | |
|---|---|---|---|
| 2,201,123 | 5/1940 | Davis | 123/198 DB |
| 3,153,403 | 10/1964 | Dobbs | 123/198 DB |
| 3,159,036 | 12/1964 | Miller | 123/386 |
| 4,092,965 | 6/1978 | Lintott | 123/386 |
| 4,355,610 | 10/1982 | Parks | 123/386 |
| 4,385,867 | 5/1983 | Straubel | 73/119 A |
| 4,512,298 | 4/1985 | Hayashi | 123/196 S |
| 4,785,778 | 11/1988 | Gibson | 123/372 |

FOREIGN PATENT DOCUMENTS

| | | | |
|---|---|---|---|
| 0180739 | 10/1983 | Japan | 123/386 |

*Primary Examiner*—Carl Stuart Miller
*Attorney, Agent, or Firm*—Donald Cayen

[57] ABSTRACT

An internal combustion engine protection system utilizes lubrication oil pressure to directly protect an engine against failure of the lubrication oil system. The protection system comprises a yieldable base member assembly that replaces the conventional fixed surface of a governor housing for resisting the governor centrifugal weights and high speed spring. The yieldable base member assembly comprises a cylinder and piston arrangement. Lubrication oil is directed to a chamber in the cylinder behind the piston. As long as the lubrication oil pressure maintains the desired value, the piston remains fixed and functions as the conventional fixed surface. Should lubrication oil pressure fall for any reason, the governor high speed spring and centrifugal weights force the piston to move in the cylinder. The high speed spring and centrifugal weights also move to actuate fuel control racks to an engine shut down condition. A temperature sensitive control valve may be installed within the engine protection system to reduce lubrication oil pressure in the cylinder chamber due to engine overheating. Lubrication oil pressure can also be reduced to shut down the engine by the presence of contaminants in the lubrication oil.

23 Claims, 7 Drawing Sheets

ENGINE PROTECTION SYSTEM

BACKGROUND OF THE INVENTION

1. Field of the Invention. This invention pertains to internal combustion engines, and more particularly to apparatus for controlling the proper operation of large diesel engines.

2. Description of the Prior Art. It is well known that internal combustion engines must be protected from operating under conditions that can damage to them. For example, lubrication oil pressure and cooling water temperature must fall within certain ranges if an engine is to perform satisfactorily over a long service life.

To protect internal combustion engines from the harmful effects of insufficient lubrication oil pressure, cooling water overtemperature, and other detrimental conditions, various protection devices have been developed. An example of prior protection devices includes that shown in U.S. Pat. No. 3,203,407, wherein a fuel shut-off is operated by compressed air. U.S. Pat. No. 4,178,901 shows a speed control that operates from a vehicle speedometer. The controls of both of the foregoing patents, as well as others, suffer the disadvantage of relying on secondary sensing and control systems that are interposed between the lubrication oil pressure and the engine fuel system, i.e., fuel flow is not controlled directly by the oil pressure itself. Further, electrical control systems such as that of the U.S. Pat. No. 4,178,901 are subject to tampering, such as by jumpering around various protection circuits.

U.S. Pat. No. 4,117,822 describes a protection device that is capable of being overridden by a person. The manual override limits and even defeats the usefulness of a protection system.

U.S. Pat. No. 4,120,275 discloses apparatus that operates in conjunction with an engine governor to increase fuel flow to the engine at engine startup when lubrication oil pressure is low. As the oil pressure increases, the fuel flow is decreased. The control of the U.S. Pat. No. 4,120,275 is not suitable for stopping an engine that loses lubrication oil pressure or that overheats.

In addition, none of the aforementioned devices is capable of protecting an engine from contaminated oil, which is a major cause of engine failure.

Thus, a need exists for a direct acting and tamper proof mechanism that protects an internal combustion engine against damage due to insufficient lubrication oil pressure.

SUMMARY OF THE INVENTION

In accordance with the present invention, an engine protection system is provided that utilizes directly the lubrication oil pressure of an internal combustion engine to protect the engine against loss of the lubrication oil pressure. This is accomplished by apparatus that includes a base member assembly that yieldably resists the low and high speed springs of an engine governor.

When the engine is running, the governor centrifugal weights tend to force a sliding sleeve against one end of preloaded low and high speed springs. Motion of the second end of the springs is resisted by the yieldable base member assembly of the present invention. The yieldable base member assembly is preferably constructed as a piston in combination with a cylinder. The cylinder is hydraulically connected to the engine oil pump, such that at least a portion of the pump output flows through the cylinder and an associated restrictor, and is then dumped to the crank case pan. The piston has a bearing face against which is seated the compressed high or low speed governor spring. The cylinder and piston are designed such that the normal lubrication operating pressure produces enough force on the piston to adequately resist the governor low and high speed springs under all engine operating speeds. Thus, under normal conditions the piston functions as a fixed base in a manner identical to the stationary spring resisting member of a conventional internal combustion engine governor.

However, should the lubrication oil pressure of a running engine fall for any reason, the compressed governor low and high speed springs force the piston into the cylinder, thereby moving the base against which the governor springs are seated. The travel of the piston is at least as great as the expansion of the preloaded high and low speed springs to relaxed conditions plus the travel of the governor sliding sleeve from a full fuel location to a no fuel location. As a consequence, the preload in the high speed spring is relieved, and the governor weights are able to move the governor sliding sleeve in a manner simulating an engine overspeed condition with a governor having a fixed spring base. The result is that the linkages for controlling the fuel injection racks are stroked to a no fuel position, thereby stopping the engine. Movement of the yieldable base member and control linkages are independent of the engine speed at which the lubrication pressure system fails. Further, the engine cannot be restarted until proper oil pressure is again present in the base member cylinder to retain the piston bearing face at the proper operating position.

It is a feature of the present invention that it is capable of protecting the engine from contaminated oil. For that purpose, an oil filter is inserted between the oil pump and the yieldable base member assembly cylinder. In that manner, a clogged filter will cause low pressure in the base member cylinder downstream from the filter to shut down the engine even if there is an adequate oil supply in the pan and the oil pump is working properly.

Further in accordance with the present invention, the engine protection system protects the engine against overtemperature conditions. For that purpose, a temperature sensitive control valve is connected to the return line from the yieldable base member assembly cylinder. Under normal conditions, the temperature sensitive control valve blocks oil flowing therethrough, so that all the oil flowing through the cylinder passes through a restrictor and is then dumped directly to the engine pan. Should the engine overheat, the temperature sensitive valve opens to permit oil to flow therethrough and then dump the oil to the pan. The resistance to oil flow through the temperature sensitive valve is much less than the resistance of the restrictor in the cylinder return line. Consequently, the oil pressure in the yieldable base member cylinder drops when the temperature sensitive valve opens. To provide additional assurance of a reduction of lubrication oil pressure in the cylinder when the temperature sensitive valve opens, the lines to and from the temperature sensitive valve are considerably larger than the input line to the cylinder. With reduced lubrication oil pressure in the cylinder, the governor springs force the base member piston into the cylinder, and the low and high speed springs and other governor components force the fuel racks to cut off fuel to the engine cylinders. Thus, an overheated engine condition results in engine stoppage in a manner substantially identical to engine stoppage due directly to a lubrication oil pressure failure.

An important aspect of the present invention is that it is suitable for installation in a variety of commonly available internal combustion engines with minimum modification to the engines. In one commonly used engine, the governor high speed spring bears against a set-up surface of a retainer threaded into the governor housing. A technician normally sets up the governor by properly positioning the retainer relative to the governor housing so as to produce a desired amount of high speed spring preload. To adapt the present invention to that engine, a temporary yoke is substituted for the usual retainer to resist the high speed spring during set-up. The yoke has a set-up surface that is set in combination with a particular spring and optional shims to produce the desired preload in the high speed spring. The temporary yoke is then removed and the yieldable base member assembly is installed. The base member assembly is adjustable with shims such that with proper operating oil pressure the piston is seated against a bore stop in the cylinder to locate the piston bearing face at a location that duplicates the yoke set-up surface, thereby reproducing the desired governor high speed spring preload. Consequently, governor operation is identical with the yieldable base member assembly as with the temporary yoke, and as with the conventional threadable retainer.

In another commonly used internal combustion engine, the yieldable base member assembly is sandwiched between the conventional governor housing and a supply fuel pump. A bore stop in the base member assembly accurately and positively locates the piston therein at the normal working position that suits the particular governor high speed spring preload. The governor is tuned on a test stand or flow bench that simulates the engine. Governor operation when installed in the engine is identical to its operation on the flow bench.

Other advantages, benefits, and features of the present invention will become apparent to those skilled in the art upon reading the detailed description of the invention.

BRIEF DESCRIPTION OF THE DRAWINGS

FIG. 6 is a view similar to FIG. 1, but showing a temporary yoke installed in the internal combustion engine for setting the engine protection system of the present invention.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

GOVERNOR OPERATION

Figure 1:
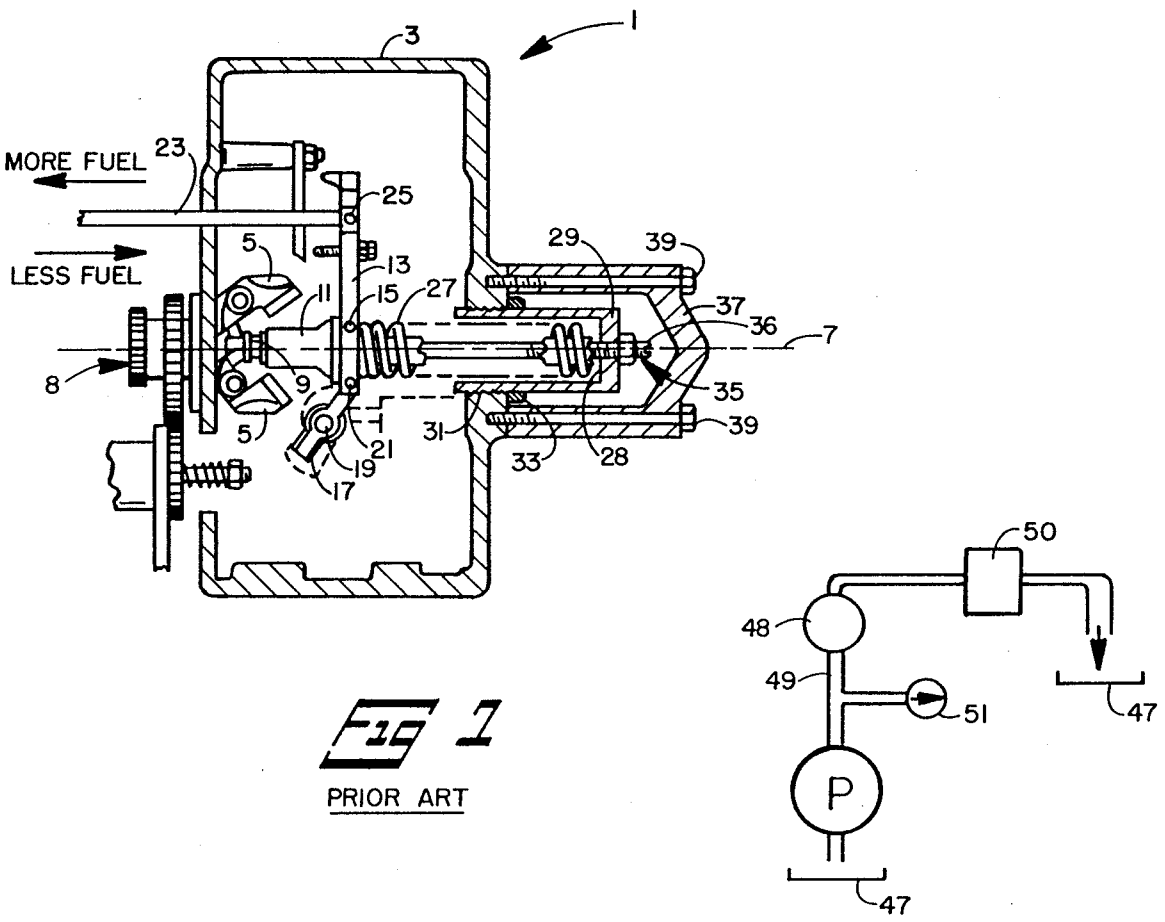
FIG 1 PRIOR ART
FIG. 1 is a partially schematic and partially cross sectional view of a portion of a typical internal combustion engine showing a conventional governor control of the engine speed.

Referring to FIG. 1, a conventional governor system 1 is illustrated that controls the speed of an internal combustion engine. The particular governor system shown is typically used on a known truck diesel engine, but it will be understood that the invention is not limited to vehicular applications.

In its essential form as pertinent to an understanding of the present invention, the governor 1 of the particular diesel engine comprises a housing 3 that rotatably supports a pair of centrifugal weights 5. The weights 5 are driven to rotate about an axis 7 by a gear train 8. The rotational speed of the weights is directly proportional to the engine speed. The weights are joined by thrust bearings 9 to a sliding sleeve 11. A governor lever 13 is pivotable about a fulcrum lever pivot point 15 fixed to the sliding sleeve 11. Pivoting of the governor lever 13 about the fulcrum level pivot point 15 is by means of a control lever 17, which is pivotable about a lever shaft 19. The control lever 17 is pivotably connected to the governor lever 13 by a pin 21 located near one end of the governor lever. A control rod 23 is pivotally connected to the second end of the governor lever by another pin 25. The control rod 23 is connected by suitable links, not illustrated in FIG. 1, to fuel injection racks for supplying fuel to the engine cylinders, as is known in the art.

A governor high speed spring 27 is captured between the sliding sleeve 11 and a bearing surface 28 of a retainer 29. The retainer 29 is formed with external threads 31 that mate with similar internal threads in the housing 3 to thereby provide adjustability to the location of the bearing surface 28 and therefore to the compression of the spring 27. A lock nut 33 is threaded on the retainer and serves as a jam nut to maintain the retainer in the desired location relative to the housing. Reference numeral 35 represents an idle speed adjustment mechanism that includes an adjusting screw 36 threaded into the retainer. The construction and operation of the idle speed adjustment mechanism is known in the art, and a detailed description is not considered necessary for an understanding of the present invention. A cap 37 covers the retainer 29, lock nut 33, and idle speed adjustment mechanism 35. The cap 37 is attached to the governor housing 3 by conventional screws 39. Under normal conditions, fuel to the engine cylinders is controlled by the operating lever 17 acting through the pin 21, governor lever 13, and control rod 23. Rotating the operating lever about the operating shaft 19 pivots the governor lever about the fulcrum level pivot point 15 to stroke the control rod 23 and associated fuel racks. Rotating the control lever clockwise in FIG. 1 causes counterclockwise rotation of the governor lever and translation of the control rod to provide more fuel to the engine cylinders. Counterclockwise rotation of the control lever results in less fuel being supplied to the engine cylinders.

The retainer 29 is adjusted with the engine stopped to produce a compression preload of approximately 1.5 to 2 millimeters in the high speed spring 29 for the particular engine illustrated. When the engine is started, engine rotation causes the gear train 8 to rotate the centrifugal weights 5 about the axis 7. The weights tend to fly outwardly with respect to the axis 7. The force created by the rotating weights is transmitted to the sliding sleeve 11 and tends to move the sliding sleeve to the right in FIG. 1 and further compress either the high speed spring 27 or the low speed spring. Thus, any change in engine speed produces a change in the sliding sleeve position and a change in the spring compression force.

Should the engine speed exceed the predetermined rated speed, the rotating weights 5 produce sufficient motion of the sliding sleeve and fluid lever pivot pin such that the control rod 23 is stroked to a "less fuel" position, at which no additional fuel is needed for engine speed. At that location of the sliding sleeve and fulcrum lever pivot pin 15, the control lever 17 has no additional effect on the control of the engine. The ratio of distances between the pin 19 and the fuel lever pivot pin and between the fuel lever pivot pin and the pin 25 provides relatively large strokes of the control rod 23 for relatively small sliding sleeve travels. A three to one ratio between the travel of the control rod and sliding sleeve is common, thereby providing great sensitivity to the control rod and fuel metering racks. A typical travel of the sliding sleeve between engine idle speed and rated speed is approximately 10–15 millimeters. Thus, for the particular engine depicted, there is a total sliding sleeve travel of approximately 12–17 millimeters between the engine off and rated speed conditions. Engine slowdown from rated speed is reflected through the gear train 8 to the weights 5, which produce less force on a sliding sleeve. Consequently, the high speed spring 27 pushes the sliding sleeve and fulcrum lever pivot point to the left in FIG. 1 and thereby returns control of the engine to the control lever 17.

ENGINE LUBRICATION SYSTEM

Reference numeral 43 represents schematically a portion of a typical circuit for supplying lubrication oil to various points throughout the engine; such circuits are well known. The lubrication circuit 43 includes a pump 45 that draws oil from the fabricated with a recess 67 that provides clearance for the idle speed adjustment 35'. The piston may also have an annular portion 69 that provides lateral guidance for the high speed spring. The piston back end is formed with a short projection 70.

A line 74 is tapped into the lubrication circuit 43. The connection between the line 74 and the line 49 may be at any convenient location in the engine, but it is preferred that the connection be made downstream of the main lubrication system filters 48. The line 74 passes through the cap 57 to a chamber 71 between the back of the piston 61 and the cap. Another line 73 returns oil from the chamber through a restrictor 72 and then to the engine pan 47.

The yieldable base member assembly 53 and the restrictor 72 are designed in conjunction with each other such that with correct lubrication pressure, as measured by the gauge 51, the hydraulic force in the chamber 71 is greater than the force exerted by the governor idle and high speed springs for all positions of the sliding sleeve 11'. The oil forces the piston 61 and disk 62 to the left in FIG. 2 until a shoulder 83 on the piston strikes a bore stop 85 on the cylinder 55. The location of the disk bearing face 65 is carefully controlled, as will be explained in detail hereinafter, such that the location of the bearing face 65 is accurately known when the piston is against the cylinder bore stop 85. As long as the lubrication oil pressure maintains the required value, the piston 61 and disk 62 function as a fixed base analogous to the retainer 29 of governor 1 of FIG. 1. With proper lubrication oil pressure, the governor 41 functions exactly like the governor 1 to protect the engine against overspeed.

However, should the lubrication oil pressure in the circuit 43 fall below the required value, the governor 41 of the present invention with automatically and quickly shut the engine off. Insufficient oil pressure may occur because of a lack of oil in the pan 47, a clogged filter 48, failure of the pump 45, or other reasons. Regardless of the cause, a reduction of oil pressure in the yieldable base member assembly chamber 71 results in the governor weights 5' forcing the sliding sleeve 11' and fulcrum level pivot pin 15' to a position that strokes the control rod 23' to a fuel shutdown condition. The result is depicted in FIG. 3.

Figure 3:
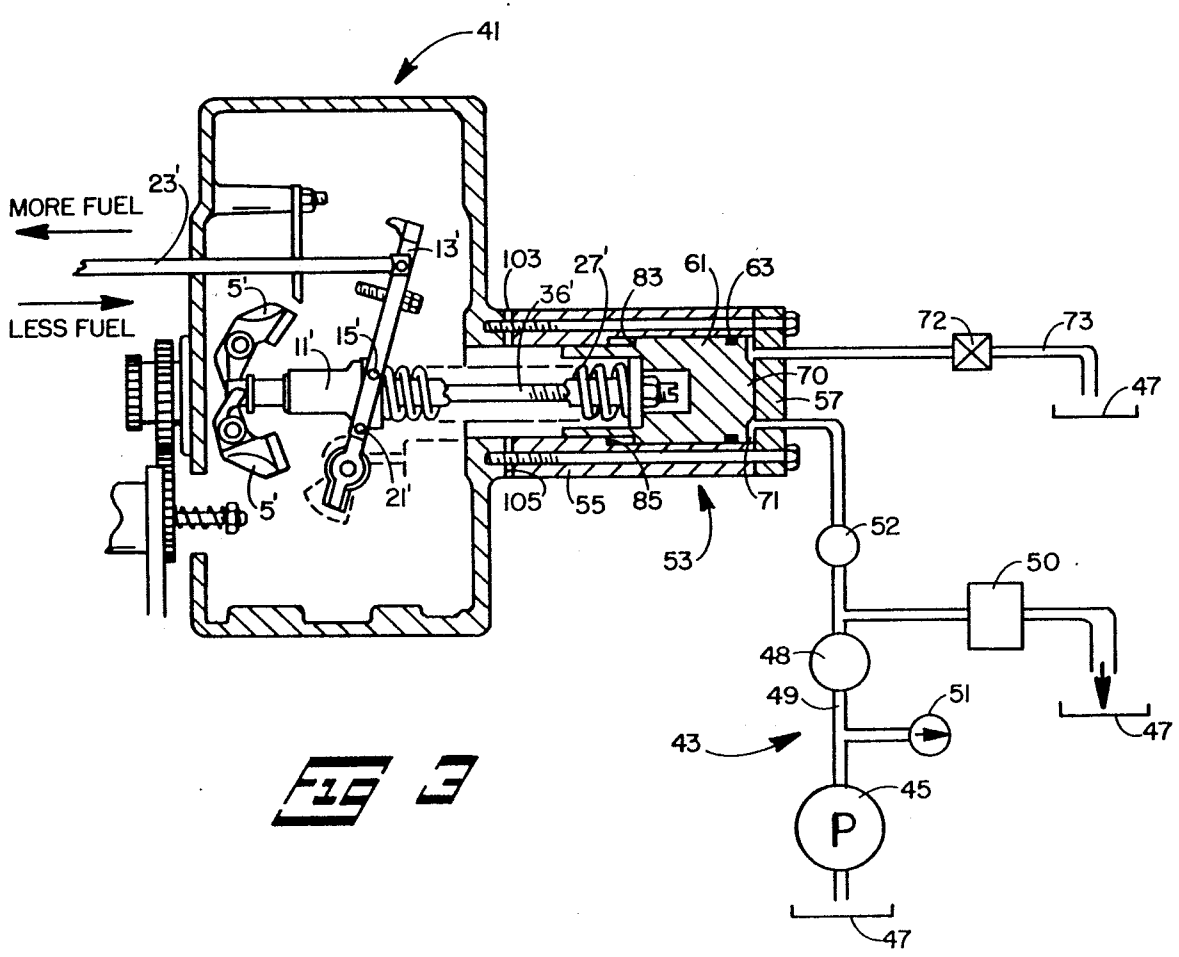
FIG. 3 is a view similar to FIG. 2, but showing the engine protection system of the present invention in an engine shutdown mode due to low lubrication oil pressure.

In FIG. 3, the governor 41 is shown at an instant when the lubrication oil pressure has fallen to a value substantially less than the minimum required pressure and the engine is about to stop. With a loss of lubrication oil pressure, the resistance to the force of the compressed idle and high speed springs is removed. Consequently, the springs push the piston 61 and disk 62 to the right in FIG. 3 until all the spring compression force is removed. The exact amount of high speed spring relaxation depends on the engine speed and thus the amount of spring compression when the oil pressure failed. With the compression force in the high speed spring removed, the governor weights 5' fly outwardly without resistance, and they move the sliding sleeve 11' to the right, together with the springs, piston, and disk, until the end of the piston projection 70 strikes the cylinder cap 57. The fulcrum lever pivot pin 15' moves simultaneously with the sliding sleeve, thereby pivoting the first end of the governor lever 13' about the control lever pin 21'. As a result, the control rod 23' is stroked to a "less fuel" position. The large ratio of control rod travel to the sleeve travel places the fuel racks in a position that completely shuts down the engine with relatively short sleeve travel. It will be appreciated that the shutdown of the engine upon loss of lubrication oil pressure is practically instantaneous. That is because the control rod 23' is stroked to a "less fuel" position immediately upon any motion of the sliding sleeve 11' and fulcrum lever pivot pin 15, when forced by the centrifugal weights 5' against the yieldable piston 61.

The specific design of the piston 61, disk 62, and cylinder 55 is dependent on the particular governor used with an internal combustion engine. For example, with a governor having a total high speed spring compression between idle and rated speeds of approximately 15 millimeters, the yieldable base member assembly 53 is designed with a piston travel of at least approximately 17 millimeters. Consequently, the sliding sleeve 11' and fulcrum level pivot pin 15' travel to a location at least approximately 17 millimeters from their respective locations when the engine is stopped and sufficient oil pressure is present. That travel of the fulcrum lever pivot pin is sufficient to stroke the control rod 23' and associated fuel racks to a complete engine shutdown condition. Since all governors known to me include a high speed spring analogous to the high speed spring 27' of FIGS. 2 and 3 that resist the motion of the sliding sleeve induced by centrifugal weights, the present invention is adaptable to those governors to shut down the engine when the lubrication oil pressure fails. The governor weights 5' are able to move the sliding sleeve and fulcrum lever pivot pin 15' to safely and quickly shutdown the engine without intervention on the part of the engine operator. In fact, the operator has no control over the governor 41 and yieldable base member assembly 53, and it is impossible to jumper or otherwise defeat the purpose of the yieldable base member assembly without major engine teardown and tampering.

ENGINE PROTECTION AGAINST CONTAMINATED LUBRICANT

Figure 2:
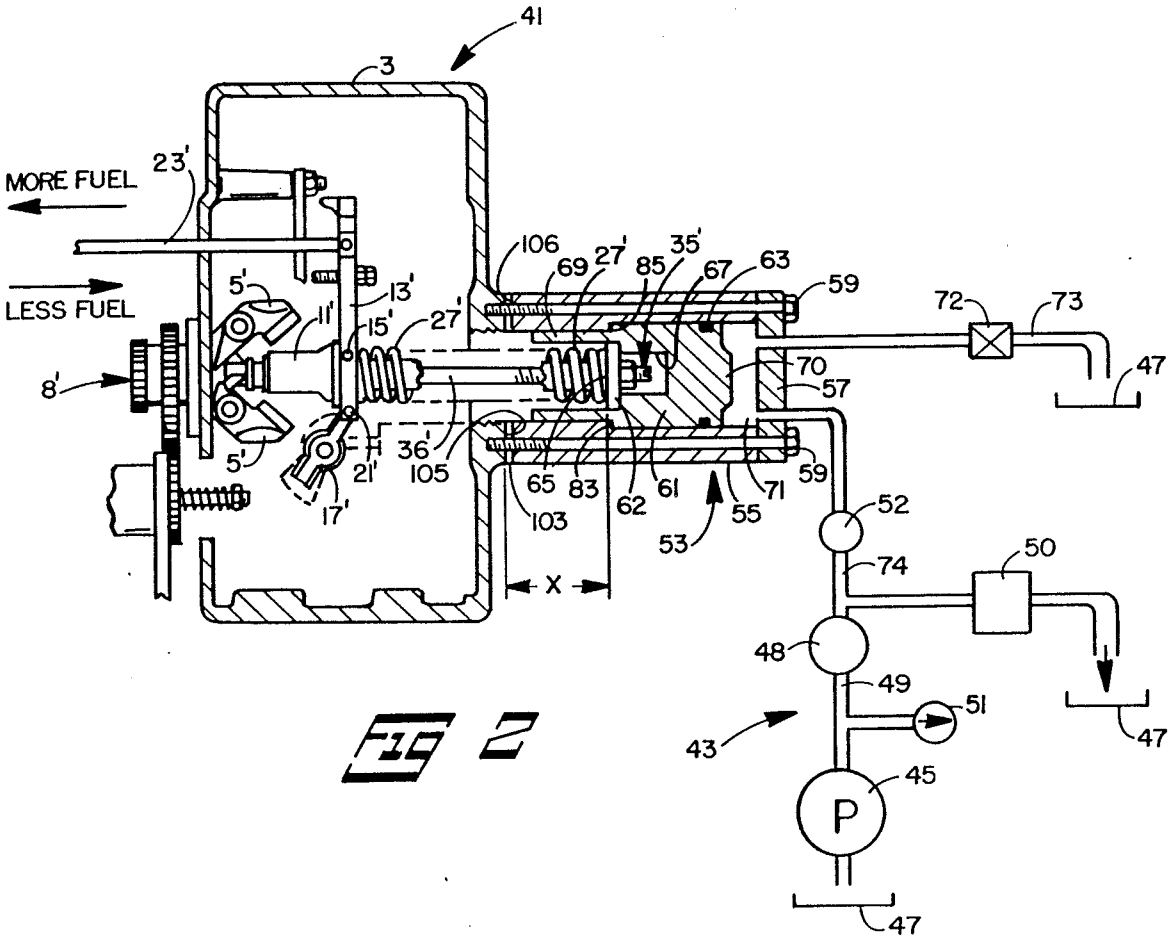
FIG. 2 is a partially schematic and partially cross sectional view of the portion of the internal combustion engine of FIG. 1 showing the engine protection system of the present invention installed on the engine and with the engine in an operating mode.

The present invention is capable of protecting an internal combustion engine from contaminated lubricant even if the oil is at the proper pressure within the engine. Since lubrication for the chamber 71 of the yieldable base member assembly 53 is taken directly from the main lubrication circuit 43, the oil flow through the chamber 71 is representative of the entire circuit 43. In FIGS. 2 and 3, a relatively small filter 52 is shown in the line 74. If the oil is contaminated, it will eventually clog the filter 52, thereby producing a reduced pressure in the chamber 71 Thus, even if the circuit 43 is producing specified oil pressure at gauge 51, the yieldable base member assembly will function to shutdown the engine as previously described if that oil is contaminated.

It is possible that lubrication oil pressure can decrease relatively slowly, as by the filter 52 or 48 gradually clogging. In that case, the force that the governor weights 5' can exert on the sliding sleeve 11' and high speed spring 27' is limited to the reduced hydraulic force on the piston 61. Any greater governor weight force will force the sliding sleeve, high speed spring, and piston backward to the right in FIG. 2 toward the cylinder cap 57. The fulcrum lever pivot pin 15' will also move to the right, thereby stroking the control rod 23' and fuel racks toward the shutdown position. However, it is still possible to operate the engine at a lower than rated speed. The reduced speed will depend on the particular pressure of the lubrication oil. The engine can operate at a maximum speed that corresponds to the sliding sleeve position with the centrifugal weights producing a force, which when added to the high speed spring preload force, equals the force acting on the piston by the oil in the chamber 71. Any attempt to operate the engine at a higher speed will not be successful, because the faster rotating centrifugal weights will cause the sliding sleeve and fulcrum lever pivot pin to stroke the control rod 23' to a "less fuel" position. Instrumentation may be installed on the engine control panel to alert the operator that the cause of the engine slowdown is insufficient oil pressure. Should the operator ignore the warning as the oil pressure continues to fall, the engine will eventually automatically slow to a stop before catastrophic failure occurs. Further, after engine shutdown occurs, the engine cannot be restarted until the source of the problem is located and repaired.

It will be recognized that proper lubrication oil pressure must be present for starting a properly functioning engine. Otherwise, the rotating governor weights 5' of the cranking engine will keep the sliding sleeve 11' and fulcrum lever pivot pin 15' in the displaced position with the piston against the cylinder cap 57. The control rod 23' is then prevented from putting the fuel racks in the full fuel position for starting. Initial oil pressure for starting the engine can be obtained by providing the engine with a compression release system for the engine intake valves. The compression release system enables the engine to crank at an increased speed and thereby allow the oil pump 45 to build up adequate pressure. Preferably, the engine can be provided with a delay system built into the engine starting mechanism. The delay system includes components that function to automatically enable the starter to build up proper pressure before the engine is cranked. As soon as proper oil pressure is available, the cranking motor is automatically engaged to start the engine. An example of a suitable delay starter is sold under the PRELUB trademark by RPM Industries.

ENGINE PROTECTION AGINST OVERHEATING

Figure 4:
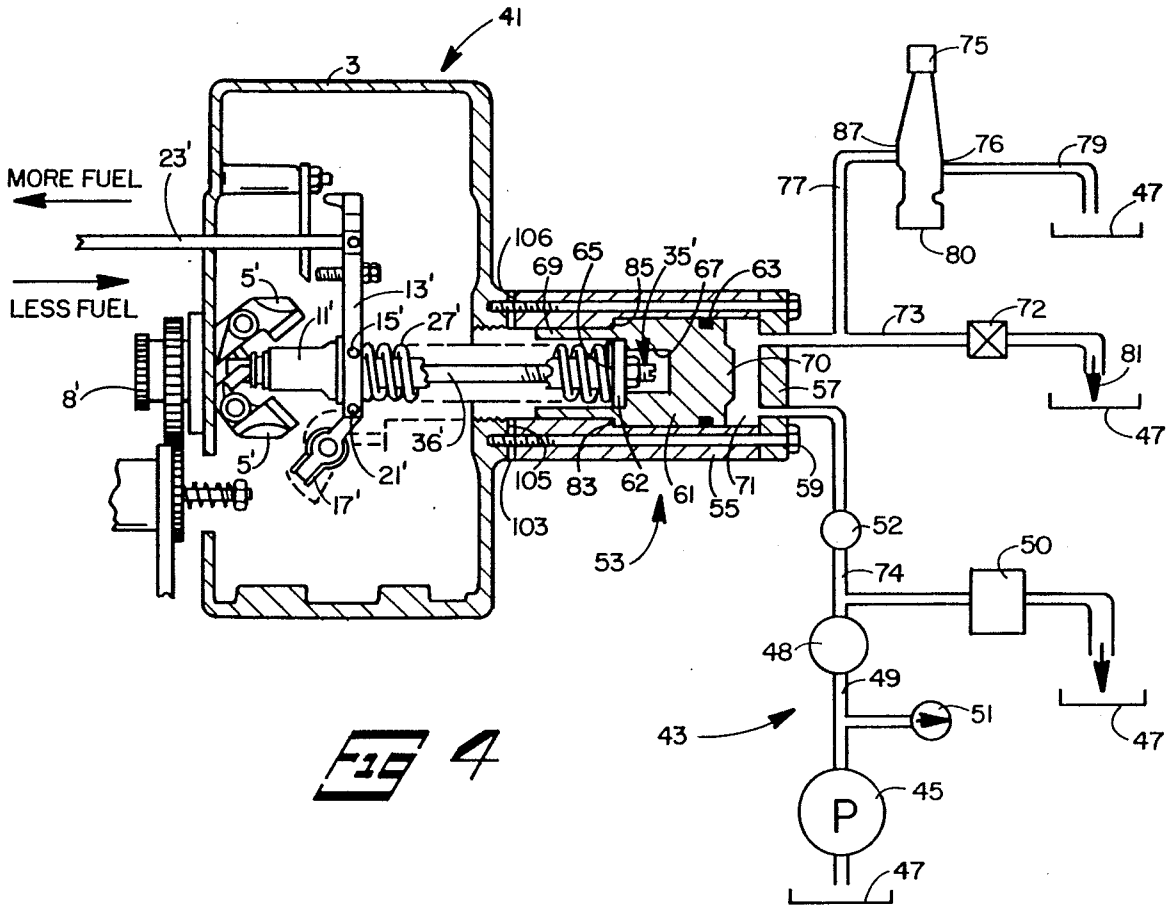
FIG. 4 is a view similar to FIG. 2, but showing a modified embodiment of the present invention.

Further in accordance with the present invention, the governor 41 is capable of reliably and simply protecting the engine against overheating. Referring to FIG. 4, a temperature sensitive control valve 75 is physically inserted into the engine cooling system in any suitable manner and location where it is exposed to the cooling fluid. A suitable temperature sensitive valve is one such as is described in U.S. Pat. No. 4,526,140, with the normal inlet port 80 being plugged. The return line 73 from the yieldable base member assembly 53 is connected to the temperature sensitive valve outlet port 87 by a line 77. A line 79 from the temperature sensitive valve dump port 76 opens to the engine pan 47. As long as the coolant temperature remains below a preset level, flow through the temperature sensitive valve 75 is blocked, and all oil flowing through the chamber 71 flows as at 81 through the return line 73 and restrictor 72 to the pan 47.

Figure 5:
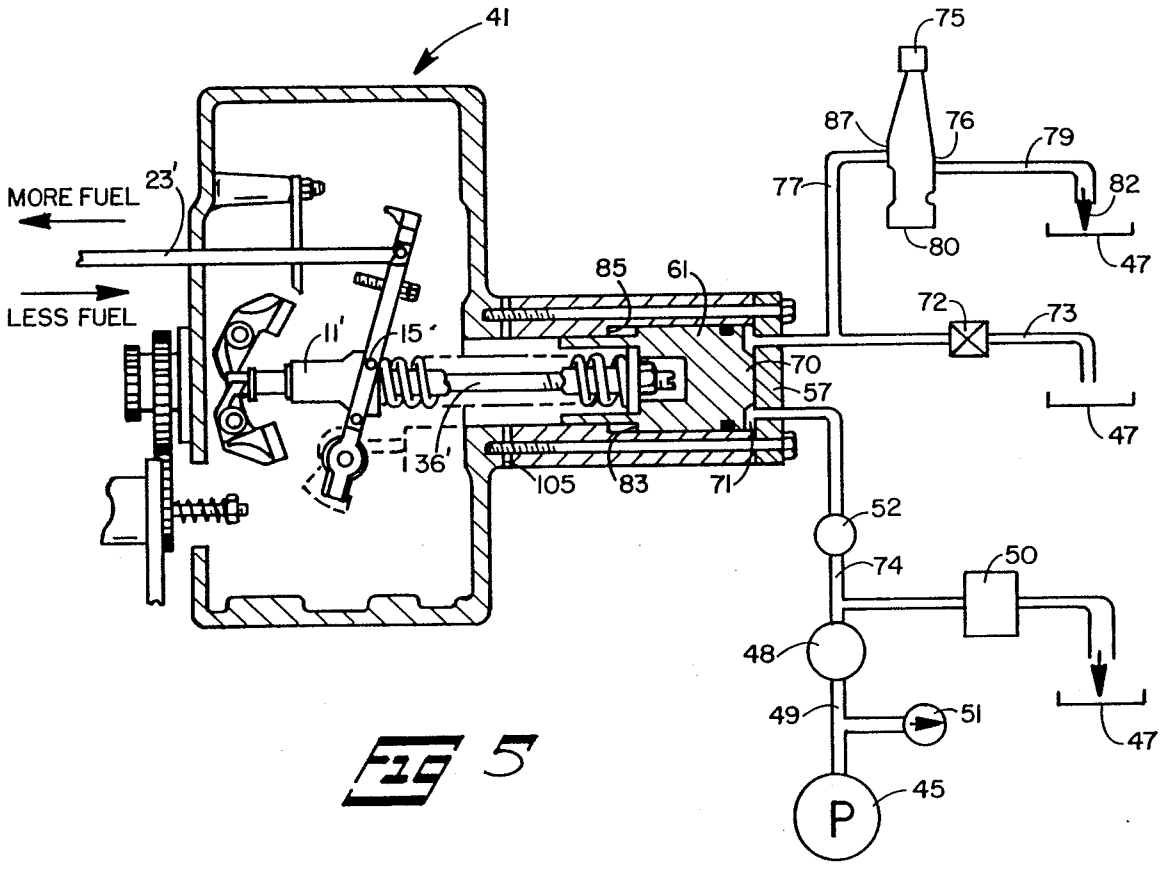
FIG. 5 is a view of the engine of FIG. 4, but showing the engine protection system of the present invention in an engine shutdown mode due to engine overheating.

Looking at FIG. 5, in the event the engine overheats, the temperature sensitive control valve 75 operates to divert most of the oil from the line 73 through the temperature sensitive valve to the dump line 79, as at 82. The temperature sensitive valve and dump line 79 have a much lower resistance to oil flow than the restrictor 72 and the return line 73, so that oil from the chamber 71 flows with almost no resistance back to the pan 47. The lack of oil pressure in the lines 77 and 79 and in the temperature sensitive control valve is reflected back to the yieldable base member assembly chamber 71. As a result, the piston 61 and disk 62 are forced by the sliding sleeve 11', centrifugal weights 5', and the governor springs against the cylinder cap 57. When the sliding sleeve moves to the right in FIG. 5, the fulcrum lever pivot pin 15' is correspondingly displaced and consequently strokes the control rod 23' to a shutdown position. In that manner, the engine is protected against overheating by utilizing the lubrication oil pressure in a manner very similar to the way the engine is protected directly against insufficient oil pressure. Moreover, the engine protection system of the present invention functions to protect the engine against overheating at all engine speeds in a manner that greatly reduces the possibility of tampering and defeating the protection system. As many temperature sensitive valves 75 as desired may be installed throughout the engine. For example, on a V-8 engine, one temperature sensitive valve may be installed in each head. Thus, localized overheating conditions can be sensed and the engine protected from them.

ENGINE SET-UP

Now turning to FIG. 6, apparatus is shown for setting up the governor 41 in conjunction with the yieldable base member assembly 53 of FIGS. 2–5. The governor is removed from the engine and placed on a test stand in a known manner. A temporary yoke 95 is mounted to the housing 3' by screws 97. A threaded disk 99 is inserted in a counterbore in the yoke and receives the idle speed adjustment screw 36'. The high speed spring 27' is chosen to suit the particular engine and its desired operating characteristics. The temporary yoke is removed from the housing, and that dimension X is measured, as with a depth micrometer.

Now referring back to FIG. 2, shims 103 may be used between the cylinder 55 of the yieldable base member assembly 53 and the housing mounting surface 105 to locate the piston disk bearing face 65 at the same dimension X from the housing mounting surface 105, when the piston shoulder 83 is against the cylinder bore stop 85, as the set-up surface 101 of the temporary yoke 95 (FIG. 6). With that accomplished, the governor will operate with the yieldable base member assembly 53 installed and the piston shoulder 83 against the cylinder bore stop 85 in a manner identical to governor operation when the temporary yoke 95 and disk 99 were installed. Thus, with proper lubrication oil pressure in the chamber 71, the yieldable base member assembly functions identically to the temporary yoke and disk 99 during the set-up procedure.

ALTERNATE EMBODIMENTS

Figure 7:
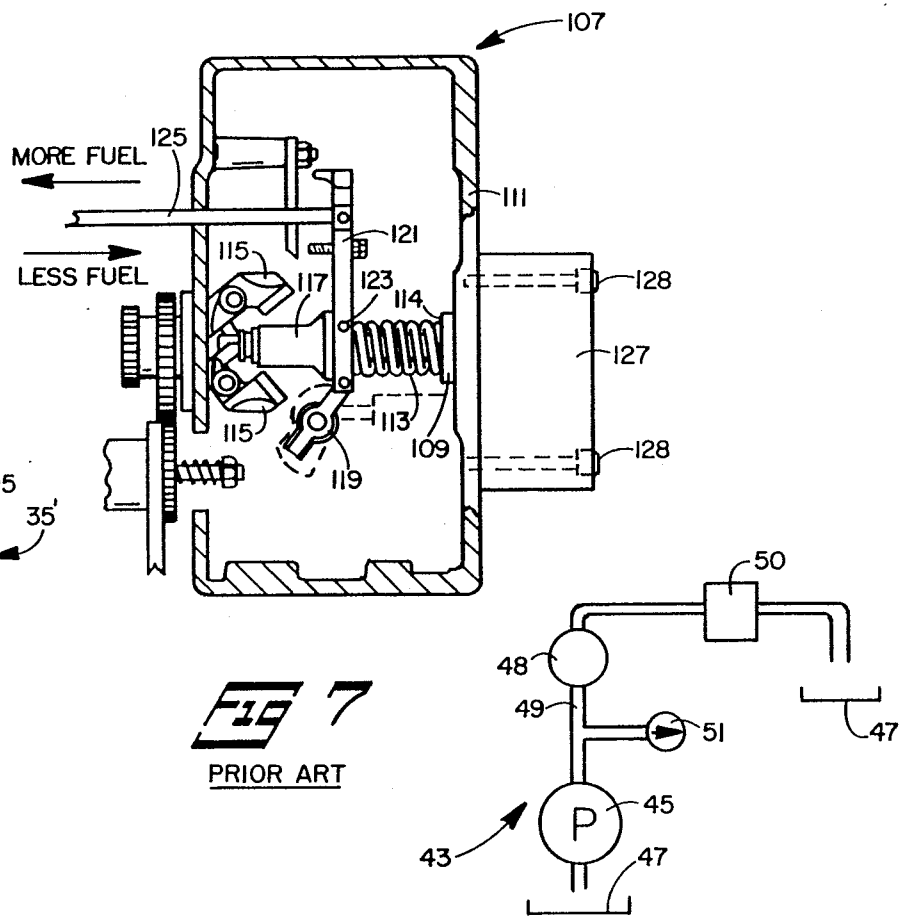
FIG. 7 PRIOR ART
FIG. 7 is a partially schematic and partially cross sectional view of an alternate conventional internal combustion engine having a governor speed control.
Figure 9:
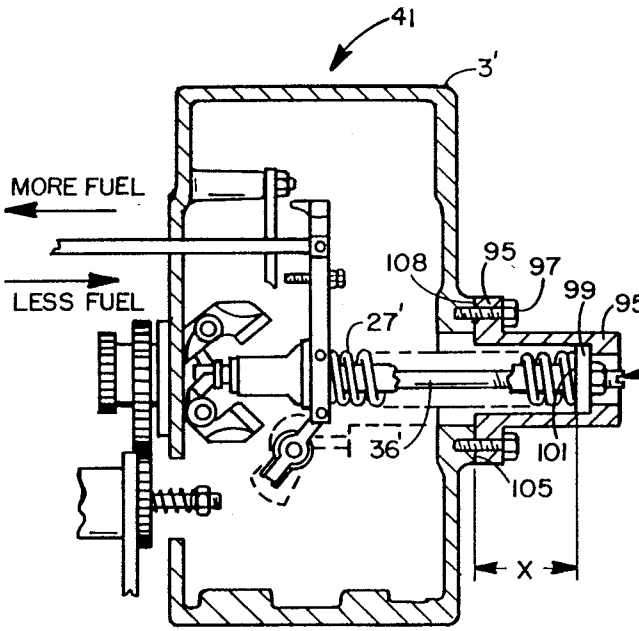

It is a feature of the present invention that it can be used on several makes and models of commercial internal combustion engines and their respective governors. Looking at FIG. 7, a conventional governor 107 is illustrated that utilizes a fixed pad 109 of the conventional governor housing 111 to seat the governor high speed spring 113 on pad face 114. The governor 107 contains centrifugal weights 115, a sliding sleeve 117, a control lever 119, a governor lever 121, a fulcrum lever pivot pin 123, and a control rod 125, all of which are generally similar to the corresponding parts described previously with respect to governors 1 and 41. The particular governor depicted in FIG. 7 includes a fuel supply pump 127 held in place on the governor housing 111 with screws 128. Now looking at FIG. 8, a modified yieldable base member assembly 129 according to the present invention is shown mounted to the governor housing 111 between that housing and the supply pump 127. The yieldable base member assembly 129 comprises a cylinder 130 and a cap 131. The cylinder 130 has a bore stop 133. A piston 135 with seals 136 is slidable within the cylinder 130. The piston 135 has a shoulder 137. The piston is dimensioned such that when the shoulder 137 is against the cylinder bore stop 133, the end face 139 of the piston is at the same location as the surface 114 of the housing pad 109 of FIG. 7. The piston is held against the bore stop by oil in a chamber 141 located between the back end of the piston and the cylinder cap 131. Reference numeral 143 represents a shaft for operating the supply pump 127, as is known in the art. With the yieldable base member assembly 129 in place, the shaft 143 is longer than a corresponding shaft without the presence of the yieldable base member assembly. Longer mounting screws 144 for replacing the screws 128 is the only other change required to the governor when using the yieldable base member assembly 129.

Oil is supplied to the chamber 141 by tapping the yieldable base member assembly 129 into the engine lubrication circuit 43' in a manner similar to the tapping of the yieldable base member assembly 53 into the lubrication circuit 43 as described in connection with FIGS. 2–5. The operation of the governor 107 is substantially similar to that of the governor 41 described previously. As long as the lubrication oil pressure maintains a satisfactory value, the piston 135 acts as a fixed seat for the governor high speed spring 113. In that situation, the governor weights 115 move the sliding sleeve 117 against the high speed spring 113 and piston face 139 as though the piston were fixed to the housing 111. Engine overspeed is prevented by the movement of the sliding sleeve 117 to a position at which the governor lever 121 strokes the control rod 125 to the fuel shut-off position.

Figure 8:
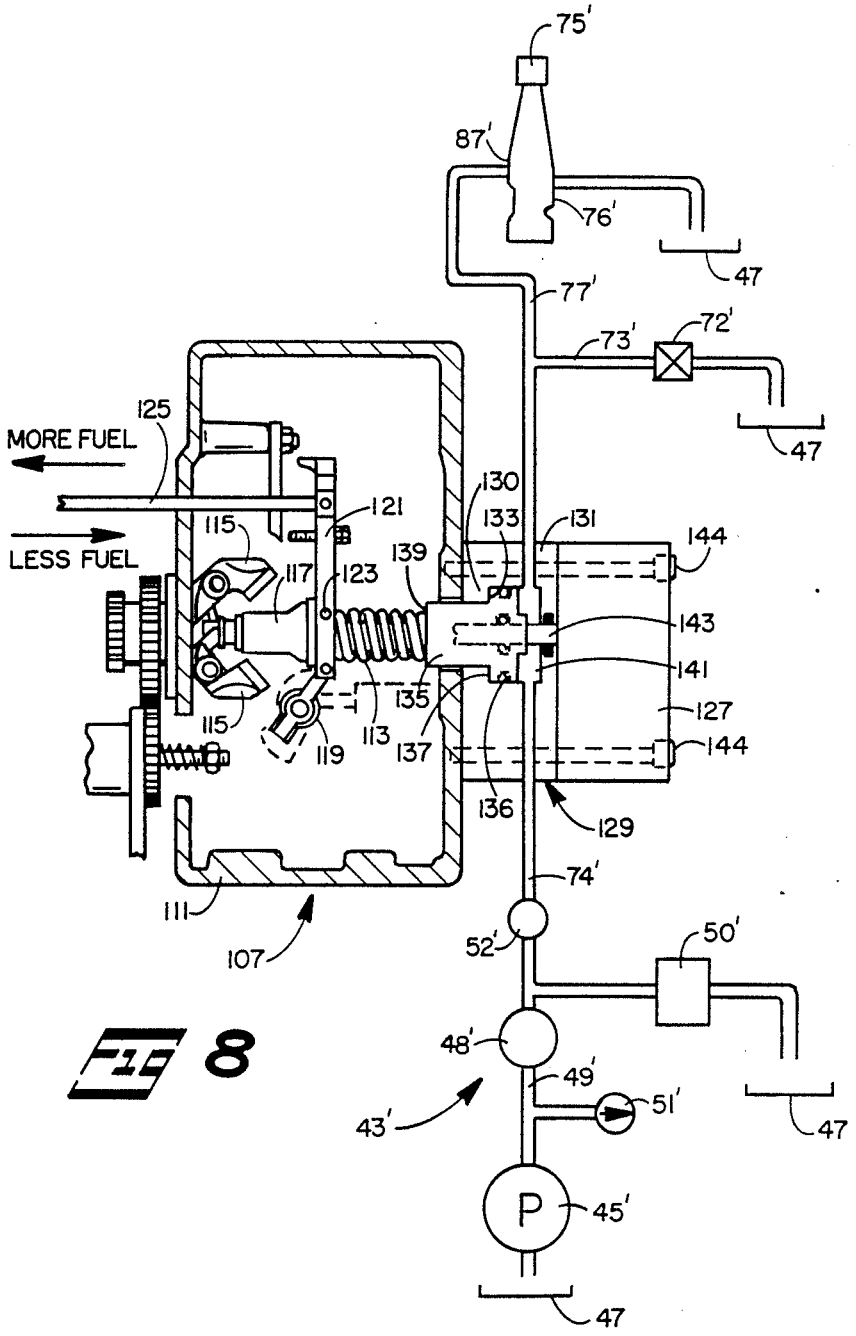
FIG. 8 is a view similar to FIG. 7 but showing a modified embodiment of the present invention installed on the engine.

The engine of FIG. 8 is protected against lubrication pressure failure and contamination by the yieldable base assembly member 129 in a manner similar to the protection provided by the governor 41 and yieldable base assembly member 53 of FIGS. 2 and 3. Similar to the protection system of FIGS. 4 and 5, the temperature sensitive control valve 75' of the engine protection system of FIG. 8 operates to dump lubrication oil if the engine overheats. Should overheating occur, the temperature sensitive valve 75' dumps oil directly from the dump port 76' rather than directing the oil through the return line 73' and restrictor 72'

Thus, it is apparent that there has been provided, in accordance with the invention, an engine protection system that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. Apparatus useful for protecting an internal combustion engine having a governor with a housing secured to the engine and a lubrication oil system against failure due to insufficient lubrication oil pressure comprising:

(a) cylinder means for fixedly mounting to and being immobile relative to the engine governor housing and for tapping into the engine lubrication oil system; and (b) piston means received within the cylinder means for cooperating therewith to define a cylindrical chamber for receiving a portion of the engine lubrication oil and for sliding within the cylinder means between first and second positions, the piston means having a bearing face contactable by the governor, the piston means being slidable to the first position against the governor when a predetermined lubrication oil pressure is present in the chamber to permit the governor to control the engine to a running condition, the piston means being slidable by the governor to the second position free of any force that resists sliding of the piston means to the second position when a lubrication oil pressure less than the predetermined lubrication oil pressure is present in the chamber to thereby cause the governor to control the engine to a shut down condition.

2. A protection system for an internal combustion engine having a lubrication oil circuit including a source of lubrication oil and a governor with a housing that is secured to the engine and a high speed spring for controlling the engine between a running condition and a shut down condition in correlation with compression of the high speed spring comprising:

(a) a yieldable base member assembly comprising:
(i) cylinder means for fixedly mounting to and being immobile relative to the engine governor housing; and
(ii) piston means received in the cylinder means and slidable therein between first and second positions for cooperating with the cylinder means to define a cylindrical chamber, the piston means having a bearing face in contact with the governor high speed spring when the cylinder means is mounted to the governor housing;

(b) means for tapping into the engine lubrication oil circuit and for providing lubrication oil pressure therefrom to the chamber at a predetermined pressure sufficient to force the piston means to the first position thereof within the cylinder means and to compress the governor high speed spring when the cylinder means is mounted to the governor housing and thereby enable the governor to control the engine to the running condition, a lubrication oil pressure in the chamber less than the predetermined pressure being insufficient to force the piston to the first position thereof and to compress the governor high speed spring; and (c) means for returning lubrication oil from the chamber to the source of engine lubrication oil, so that lubrication oil pressure in the cylinder means less than the predetermined pressure enables the high speed spring to slide the piston means to the second position thereof in the cylinder means free of any resistance to sliding of the piston means from the first to the second positions thereof and thereby relax the high speed spring and cause the governor to control the engine to a shut down condition.

3. In combination with an internal combustion engine having a governor including a housing, a sliding sleeve, and a high speed spring for controlling the engine between a running condition and a shut down condition in response to compression and relaxation, respectively, of the high speed spring; and a lubrication circuit for directing lubrication oil at a predetermined pressure from a source thereof to selected lubrication points, a yieldable base member assembly comprising:

(a) cylinder means fixedly mounted to and being immobile relative to the governor housing for receiving lubrication oil from the engine lubrication circuit; and (b) piston means having a bearing face in contact with the governor high speed spring for sliding within the cylinder means between a first position wherein the piston means compresses the governor high speed spring to enable the governor to control the engine to an operating condition and a second position wherein the piston means yields to the governor high speed spring to cause relaxation of the governor high speed spring and thereby cause the governor to control the engine to a shut down condition.

4. An engine protection system comprising:

(a) a governor comprising:
(i) a housing;
(ii) a high speed spring supported in the housing and having first and second ends;
(iii) centrifugal weight means for moving within the housing and bearing against the high speed spring first end to create a force against the high speed spring in response to rotation of the engine; and
(iv) fuel control means actuated by the centrifugal weight means for controlling the engine between an operating condition and a shut down condition in response to movement of the centrifugal weight means and the high speed spring;

(b) a yieldable base member assembly comprising:
(i) cylinder means for fixedly mounting to the governor housing and being immobile relative thereto; and
(ii) piston means received in the cylinder means for cooperating therewith to define a cylindrical chamber and for sliding within the cylinder means between a first position whereat the piston means cooperates with the governor centrifugal weight means to compress the governor high speed spring therebetween to enable the centrifugal weight means and fuel control means to control the engine in an operating condition, and a second position whereat the piston means yielded to the force of the centrifugal weight means and the high speed spring free of any force that tends to resist the force of the governor centrifugal weight means and the high speed spring to relax the high speed spring and to cause the centrifugal weight means and fuel control means to control the engine to a shut down condition; and (c) a lubrication circuit comprising:
(i) a source of lubrication oil; and
(ii) first circuit means for supplying lubrication oil from the source thereof to the cylindrical chamber at a predetermined pressure sufficient to maintain the piston in the first position.

5. A governor for controlling the speed of an internal combustion engine having a lubrication system comprising:

(a) a housing;
(b) a spring having first and second ends;
(c) centrifugal weight means within the housing in contact with the spring first end for producing a force on the spring proportional to the engine speed and for controlling the engine between an operating and a shut down condition; and
(d) yieldable base means in contact with the spring second end for capturing the spring between the yieldable base means and the centrifugal weight means, the yieldable base means being movable between a first position whereat it cooperates with the centrifugal weight means to compress the spring in correlation to the force produced by the centrifugal weight means on the spring to thereby enable the centrifugal weight means to control the engine in an operating condition, and a second position whereat the yieldable base means is forced away from the centrifugal weight means free of any force tending to resist the yieldable base from being forced away from the centrifugal weight means to relax the spring and cause the centrifugal weight means to move to a position whereat it controls the engine to a shut down condition.

6. A method of controlling an internal combustion engine comprising the steps of:

(a) providing a governor having a housing, centrifugal weights, and a high speed spring for controlling the engine in a running condition or in a shut down condition in response to motion of the governor centrifugal weights and compression of the high speed spring;

(b) mounting a yieldable base having a bearing face bearing against the governor high speed spring to the governor housing;

(c) providing engine lubrication oil pressure at a predetermined pressure against the yieldable base to locate the yieldable base at a predetermined first position to compress the governor high speed spring and resist movement of the governor centrifugal weights;

(d) providing a yoke having a set-up surface;

(e) mounting the yoke to the governor housing alternately with the yieldable base with the yoke set-up surface bearing against the governor high speed spring;

(f) locating the yoke set-up surface at a location coincident with the location of the yieldable base bearing face when the yieldable base is mounted to the governor housing at the first predetermined position to produce a selected compression in the governor high speed spring; and (g) rotating the centrifugal weights to control the engine to a running condition, so that the governor operation is set by means of the yoke.

7. The apparatus of claim 1 further comprising a temporary yoke for mounting to the engine governor housing interchangeably with the cylinder means, the temporary yoke having a set-up surface that is locatable in substantially the same plane when the temporary yoke is mounted to the governor housing as the piston means bearing face is located when the cylinder means is mounted to the governor housing and the piston means is in the first position within the cylinder means.

8. The protection system of claim 2 wherein the cylinder means comprises a cylinder fixedly mounted to and being immobile relative to the governor housing and defining a bore stop for locating the piston means at the first position thereof.

9. The protection system of claim 8 further comprising a temporary yoke mountable interchangeably with the cylinder means to the governor housing, the temporary yoke having a set-up surface when the temporary yoke is mounted to the governor housing that is coplanar with the piston means bearing face when the cylinder means and piston means are mounted to the governor housing and the piston means is at the first position thereof.

10. The protection system of claim 2 wherein the means for returning the lubrication oil from the chamber to the source of engine lubrication oil comprises:

(a) a lubrication return line from the chamber to the source of lubrication oil; and (b) a restrictor placed in the lubrication return line and sized in conjunction with the piston means and the cylinder means to cooperate therewith to provide sufficient force on the piston means to force it to the first position thereof when the predetermined lubrication oil pressure is present in the chamber.

11. The protection system of claim 2 wherein the means for tapping into the engine lubrication oil circuit and for providing lubrication oil pressure therefrom to the chamber comprises means for filtering contaminants from the engine lubrication oil and for causing the lubrication oil pressure in the chamber to fall to less than the predetermined lubrication oil pressure when a predetermined quantity of contaminants has been filtered and thereby cause the governor to control the engine to a shut down condition, so that the protective system protects the engine against contaminated lubrication oil.

12. The combination of claim 3 wherein the piston means cooperates with the cylinder means to define a cylindrical chamber that forms a portion of the internal combustion engine lubrication circuit, the piston means being maintained in the first position when the engine lubrication oil pressure in the chamber is at a predetermined value, and the piston means sliding to the second position free of any force tending to resist piston means sliding to the second position thereof when the lubrication oil pressure in the chamber is below the predetermined value, so that loss of lubrication oil pressure below the predetermined value causes the piston means to slide freely to the second position thereof and cause the governor to control the engine to a shut down condition.

13. The combination of claim 12 wherein:

(a) the engine lubrication oil received int he chamber is discharged therefrom to the engine lubrication circuit through a return line; and (b) the return engine lubrication oil flows through a restrictor placed in the return line, the restrictor being designed in conjunction with the cylinder means and the piston means to produce sufficient force on the piston means to maintain it in the first position when the predetermined lubrication oil pressure is present in the chamber.

14. The combination of claim 13 further comprising valve means inserted in the engine lubrication circuit between the yieldable base member assembly chamber and the source of lubrication oil for sensing engine temperature to selectively direct lubrication oil from the chamber to the source of engine lubrication oil through the restrictor in response to sensing an engine temperature below a predetermined temperature, and from the chamber to the source of engine lubrication oil through the valve means in response to sensing an engine temperature above the predetermined temperature, the valve means having a resistance sufficiently lower than the restrictor resistance such that lubrication oil pressure in the chamber falls below the predetermined oil pressure when the valve means directs the lubrication oil therethrough to thereby cause the governor to control the engine to a shut down condition.

15. The combination of claim 3 further comprising a temporary yoke for mounting to the governor housing interchangeably with the cylinder means, the temporary yoke having a set-up surface for bearing against the governor high speed spring, the temporary yoke set-up surface being located at a location when the temporary yoke is mounted to the governor housing that is coincident with the piston means bearing face when the cylinder means is mounted to the governor housing and the piston means is at the first position thereof within the cylinder means.

16. The engine protection system of claim 4 further comprising second circuit means for returning lubrication oil from the chamber to the source of lubrication oil, the second circuit means including a restrictor through which the return lubrication oil flows, the restrictor being designed in conjunction with the piston means and the cylinder means to produce sufficient force from the predetermined lubrication oil pressure in the chamber to force the piston means to the first position thereof.

17. The engine protection system of claim 16 further comprising a temperature sensitive control valve in the second circuit means between the chamber and the restrictor, the temperature sensitive control valve selectively directing lubrication oil from the chamber through the restrictor in response to sensing a temperature less than a predetermined temperature and through the temperature sensitive control valve in response to sensing a temperature greater than the predetermined temperature, the temperature sensitive control valve having a resistance to flow therethrough that is sufficiently smaller than the resistance to flow through the restrictor such that the lubrication oil pressure in the chamber falls to a pressure less than the predetermined lubrication oil pressure when lubrication oil flows through the temperature sensitive control valve, so that engine overtemperature conditions causes the piston means to slide to the second position thereof within the cylinder means and thereby cause the governor to control the engine to a shut down condition.

18. The engine protection system of claim 4 further comprising a temporary yoke mounted interchangeably with the cylinder means and piston means to the governor housing, the temporary yoke being adjustable relative to the governor centrifugal weight means to set the engine operating condition, the temporary yoke simulating the piston means when the temporary yoke is mounted to the governor housing.

19. The governor of claim 5 wherein the yieldable base member assembly comprises:

(a) a cylinder fixedly mounted to the housing and being immobile relative thereto; and (b) piston means received within the cylinder and having a bearing face that contacts the spring second end, the piston means being movable within the cylinder between the first and second positions.

20. The governor of claim 19 wherein the cylinder and piston means define a cylindrical chamber that is tapped into the engine lubrication system, the piston means being forced to the first position thereof within the cylinder when the engine lubrication pressure is at a predetermined amount, the piston means being forced by the centrifugal weight means and the spring to the second position thereof free of any force tending to resist the yieldable base from being forced away from the centrifugal weight means when the engine lubrication pressure is less than the predetermined amount, so that the centrifugal weight means controls the engine to the shut down condition when the engine lubrication pressure in the chamber is less than the predetermined amount.

21. The governor of claim 19 further comprising yoke means for mounting to the housing interchangeably with the cylinder, the yoke means having a set-up surface for contacting the spring second end at a selected location for setting the engine operative condition when the yoke means is mounted to the housing, the yoke means set-up surface being coincident with the location of the piston means bearing face when the cylinder and piston means are mounted to the housing.

22. The method of claim 6 wherein the step of providing engine lubrication oil pressure against the piston comprises the steps of:

(a) providing a first lubrication oil circuit for providing lubrication oil to the cylinder;

(b) providing a second lubrication oil circuit for returning lubrication oil from the cylinder; and (c) designing and installing a restrictor in the second lubrication oil circuit for cooperating with the piston and cylinder to provide sufficient force to locate the piston and disk in the first position thereof when the lubrication pressure is at the predetermined pressure.

23. The method of claim 22 comprising the further steps of:

(a) sensing contaminants in the lubrication oil in the first lubrication oil circuit;

(b) reducing the lubrication oil pressure in the chamber in response to sensing contaminants in the lubrication oil; and (c) moving the piston and disk to the second position thereof and thereby cause the centrifugal weights to control the engine to a shut down condition.

* * * * *